United States Patent [19]

Beske et al.

[11] Patent Number: 4,726,147

[45] Date of Patent: Feb. 23, 1988

[54] SLIDEABLE PANEL UNIT INTERLOCK

[75] Inventors: Scott R. Beske, Stillwater, Minn.; Thomas P. Coach, Eau Claire, Wis.; Jeffrey M. Lynn, Marine On St. Croix, Minn.

[73] Assignee: Andersen Corporation, Bayport, Minn.

[21] Appl. No.: 926,392

[22] Filed: Nov. 3, 1986

[51] Int. Cl.[4] ..... E05D 15/16

[52] U.S. Cl. ..... 49/406; 49/458; 49/483; 49/485

[58] Field of Search ..... 49/458, 406, 483, 485; 52/207

[56] References Cited

U.S. PATENT DOCUMENTS

| | | | |
|---|---|---|---|
| 637,623 | 11/1899 | Lane . | |
| 856,070 | 6/1901 | Kenny . | |
| 1,680,640 | 12/1926 | Tuyh . | |
| 2,534,687 | 12/1950 | Smith | 20/52 |
| 2,774,118 | 12/1956 | Nystrom | 20/22 |
| 2,843,375 | 7/1958 | Lesage | 268/53 |
| 2,878,532 | 3/1959 | Clark | 20/19 |
| 2,895,182 | 7/1959 | Evans | 49/458 X |
| 2,931,434 | 8/1960 | Steel | 160/91 |
| 2,950,756 | 8/1960 | Moloney | 160/91 |
| 3,324,597 | 6/1967 | Rich | 49/458 X |
| 3,432,966 | 3/1969 | Bordner | 49/368 |
| 4,198,785 | 4/1980 | Marulic | 49/304 |
| 4,202,137 | 5/1980 | Randall | 49/458 |
| 4,242,392 | 12/1980 | Yackiw | 428/85 |
| 4,319,430 | 3/1982 | Menard | 49/406 X |
| 4,463,046 | 7/1984 | Hutchison et al. | 428/156 |
| 4,528,788 | 7/1985 | Yackiw et al. . | |

FOREIGN PATENT DOCUMENTS

| | | | |
|---|---|---|---|
| 2307113 | 11/1976 | France | 49/406 |

*Primary Examiner*—Philip C. Kannan

*Attorney, Agent, or Firm*—Merchant, Gould, Smith, Edell, Welter & Schmidt

[57] ABSTRACT

A weatherstrip (20) for use with a slideable panel unit having a first panel and second panel, one of the panels being a slideable panel is disclosed. The weatherstrip (20) includes an engaging member (21) having a leading edge (26*a–c*) and having a first end (21*a*), a center region (21*b*) and a second end (21*c*). An offset member (22) is cooperatively connected to the engaging member (21), wherein when the offset member (22) is connected to one of the panels, the engaging member (21) is in a generally parallel spaced relationship to one of the panels. The leading edge (26*b*) of the engaging member (21) is in inwardly displaced at the center region (21*b*) with respect to the leading edge (26*a*) and (26*c*) at the ends (21*a* and *c*), whereby the inward displaced region (21*b*) reduces clashing between the panels when one of the panels is bowed.

16 Claims, 10 Drawing Figures

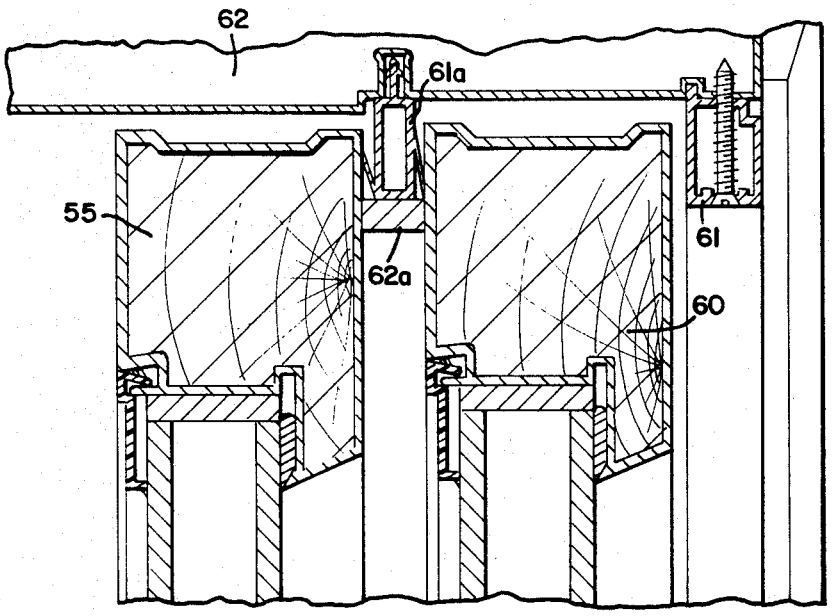
FIG.6
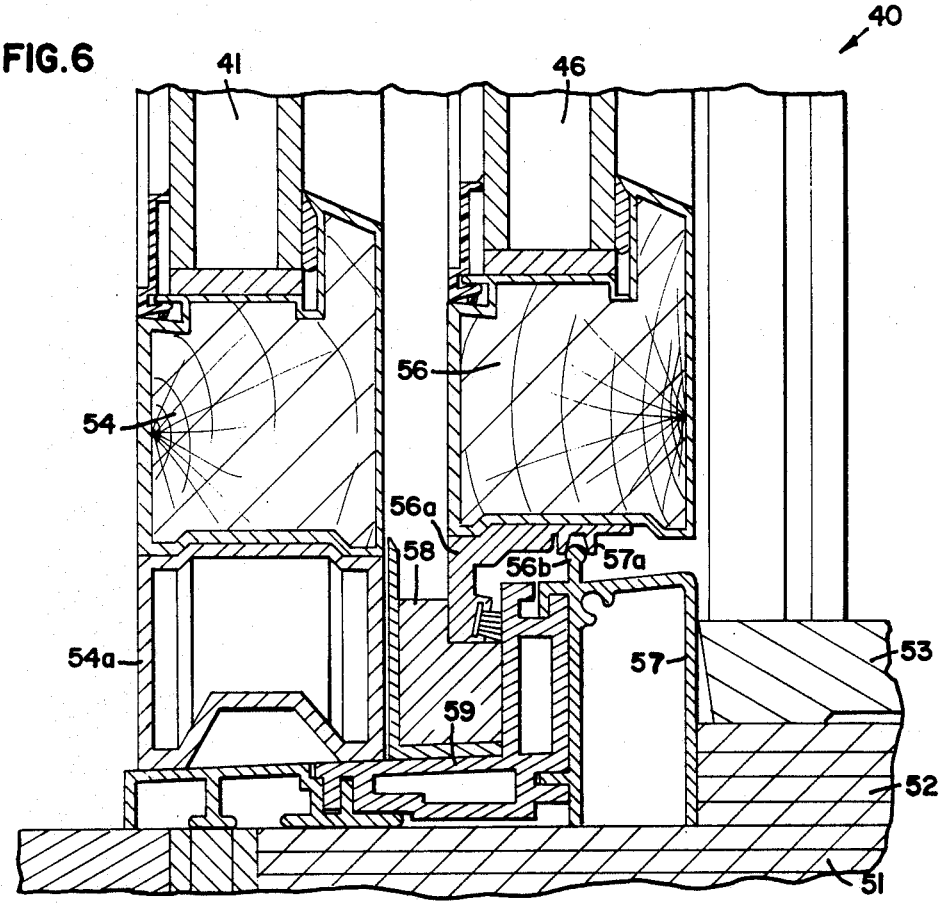

SLIDEABLE PANEL UNIT INTERLOCK

BACKGROUND OF THE INVENTION

1. Field of the Invention

This invention relates generally to a weatherstrip interlock for use with a panel unit having at least one slideable panel and more particularly to a weatherstrip for such a unit which has a width at its center region smaller than a width at its ends, whereby when the panels move from an open position to a closed position, the smaller center width reduces the likelihood of clashing if one of the panels is bowed.

2. Description of the Prior Art

For panel units having at least one operating (moving) panel, it is desirable to provide a weatherstrip between the two panels to conserve energy. Such weatherstripping is well known in the art, such as that generally shown in U.S. Pat. No. 637,623 issued to J. M. Lane.

However, with many panel units, especially those having a substantial height, such as patio doors, there is a tendency for such panels to bow or warp. This bowing is usually most noticeable in the center of the panels, as the ends are usually held in place by a guide means. If the bow in the panel is sufficient, the interlocking weatherstrip will clash and it is not possible to close the door or at best it is necessary to force the door to a closed position.

The present invention addresses the problems associated with the prior art and provides for a slideable panel unit interlock which prevents or reduces the likelihood of clashing of the panels during the closing operation.

SUMMARY OF THE INVENTION

The present invention is a weatherstrip for use with a slideable panel unit having a first panel and a second panel, one of the panels being a slideable panel. The weatherstrip includes an engaging member having a leading edge and also having a first end, center region and second end. An offset member is cooperatively connected to the engaging member, wherein when the offset member is connected to one of the panels, the engaging member is in a generally parallel spaced relationship to one of the panels. The leading edge of the engaging member is inwardly displaced from the center region with respect to the leading edge at the end regions, whereby the inwardly displaced center region reduces clashing between the panels if one of the panels is bowed.

The invention also is a slideable panel unit interlock, the unit having a first panel and a second panel, one of the panels being slideable. The interlock includes a first weatherstrip cooperatively connected to the first panel and extending substantially the length of the first panel. The first weatherstrip has a first member cooperatively connected to a second member, the second member extending away from the first panel, whereby the first member is in a spaced relationship to the first panel. A second weatherstrip is cooperatively connected to the second panel and extends substantially the length of the second panel. The second weatherstrip has a first member cooperatively connected to a second member, the second member extending away from the second panel, whereby the first member is in a spaced relationship to the second panel and when the panels are in a closed position, the first member of the first weatherstrip is between the first member of the second weatherstrip and the second panel. One of the weatherstrips has its first member having a width at its center region smaller than its width at its ends, whereby when the panels move from an open position to a close position, a smaller center width prevents clashing if one of the panels is bowed.

BRIEF DESCRIPTION OF THE DRAWINGS

FIG. 6 is a vertical cross-sectional view of a slideable panel unit in which the present invention may be incorporated.

DETAILED DESCRIPTION OF THE INVENTION

Figure 4:
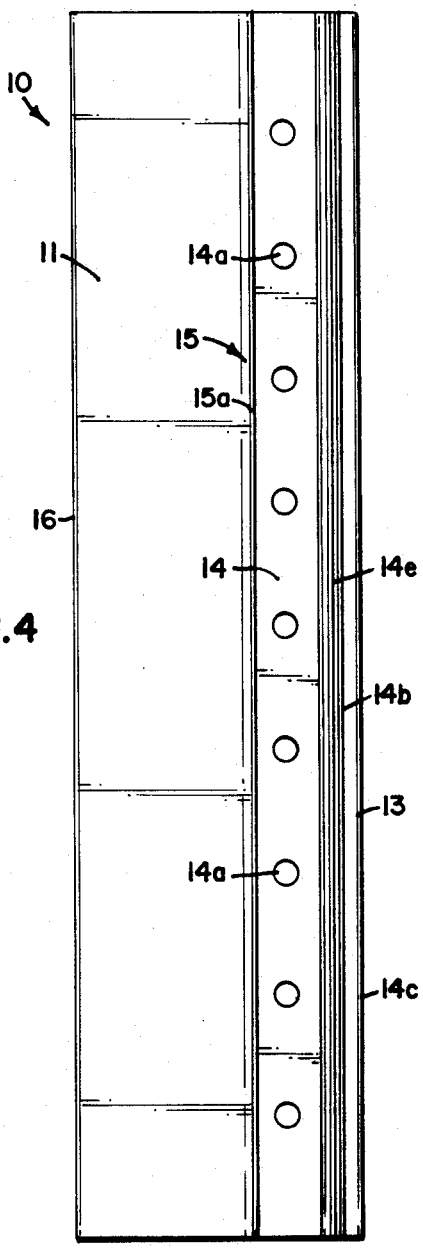
FIG. 4 is a side elevational view of the second weatherstrip portion of the interlock of the present invention.
Figure 5:
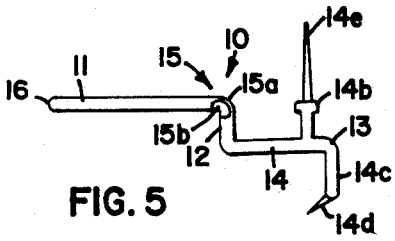
FIG. 5 is a top plan view of the second weatherstrip portion shown in FIG. 4.

Referring to the figures, wherein like numerals represent like parts throughout the several views, there is generally disclosed at 10, as shown in FIGS. 4 and 5, a weatherstrip. The weatherstrip 10 includes an engaging member 11 cooperatively connected to an offset member 12. Cooperatively connected to the offset member 12 is a mounting member 13 having a first section 14 which is generally parallel to the engaging member 11. A plurality of holes **14*a* are formed in the first section 14 for mounting purposes. Mounting flanges 14*b* and 14*c*, having sealing strip 14*d* and 14*e*, are also cooperatively connected to the first section 14. As will be more fully described hereafter the mounting flanges are constructed of a more rigid material and the sealing strips of a flexible material. It was understood that the configuration of the first section 14 will be dependent upon the environment in which the weatherstrip 10 is used. A hinge area 15 is integrally formed between the engaging member 11 and offset member 12. The hinge area 15 includes a first ply 15*a* which is preferably of the same hardness as the engaging member 11 and offset member 12 and further is preferably integral with the engaging member 11 and offset member 12. The hinge area 15** also includes a second ply 15*b* which is integrally formed with the first ply 15*a* and has a hardness essentially less than the first ply 15*a*. Such a hinge 15 is more fully described in U.S. Pat. No. 4,463,046 issued July 31, 1984, to Hutchison, et al. The engaging member has a leading edge 16. The leading edge 16 is rounded.

Figure 2:
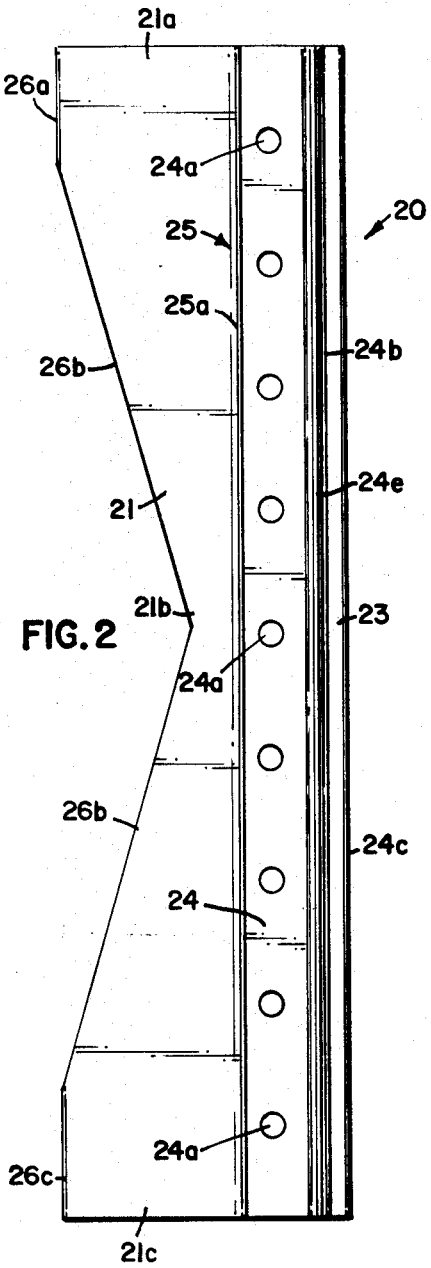
FIG. 2 is a side elevational view of the first weatherstrip portion of the interlock of the present invention.
Figure 3:
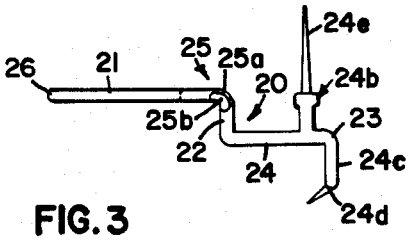
FIG. 3 is a top plan view of the first weatherstrip portion shown in FIG. 2

A second weatherstrip generally designated as 20 is shown in FIGS. 2 and 3. The weatherstrip 20 includes an engaging member 21 cooperatively connected to an offset member 22. Cooperatively connected to the offset member 22 is a mounting member 23 having a first section 24 which is generally parallel to the engaging member 21. A plurality of holes 24*a* are formed in the first section 24 for mounting purposes. Mounting flanges 24*b* and 24*c*, having a sealing strips 24*d* and 24*e*, are also cooperatively connected to the first section 24. As will be more fully described hereafter the mounting flanges are constructed of a more rigid material and the sealing strips of a flexible material. It is understood that the configuration of the first section 24 will be dependent upon the environment in which the weatherstrip 20 is used. A hinge area 25 is integrally formed between engaging member 21 and offset member 22. The hinge area 25 includes a first ply 25*a* which is preferably of the same hardness as the engaging member 21 and offset member 22 and further is preferably integral with the engaging member 21 and offset member 22. The hinge area 25 also includes a second ply 25*b* which is integrally formed with the first ply 25*a* and has a hardness essentially less than the first ply 25*a*. The hinge area 25 is similar in construction to the hinge area 15. However, it is understood that other suitable hinge means may be utilized.

The engaging member 21 has a first end 21*a*, center region 21*b* and second end 21*c*. Further, the engaging member 21 has a rounded leading edge 26 which comprises a rounded leading edge 26*a* adjacent the first end 21*a*, a rounded leading edge 26*b* adjacent the center region 21*b* and a rounded leading edge 26*c* adjacent the second end 21*c*. The leading edge 26*b* is inwardly displaced at the center region 21*b* with respect to the leading edges 26*a* and 26*c* at the ends 21*a* and 21*c*. Another way of describing the weatherstrip 20 is that the width of the first member 21 is less at its center region than at its ends.

The weatherstrips 10 and 20 are preferably formed as an integral one-piece unit. The rigid sections, that is engaging member 11, offset member 12, first section 14, and mounting flanges 14*b* and 14*c* and first ply 15*a* of weatherstrip 10 and engaging member 21, offset member 22, first section 24 and mounting flanges 24*b* and 24*c* as well as first ply 25*a* of the weatherstrip 20 are of a rigid material. In a preferred embodiment, the rigid material is a rigid exterior weathering polyvinyl chloride. It is of course understood that other rigid thermoplastic materials or other suitable materials may also be utilized. The flexible areas of the weatherstrips, namely the second ply 15*b* and sealing strips 14*d* and 14*e* of weatherstrip 10 and the second ply 25*b* and sealing strips 24*d* and 24*e* of the weatherstrip 20 are of a flexible material. In a preferred embodiment, the flexible material is a 70 durometer exterior weathering polyvinyl chloride. It is also understood that other suitable flexible materials may be utilized.

Figure 1:
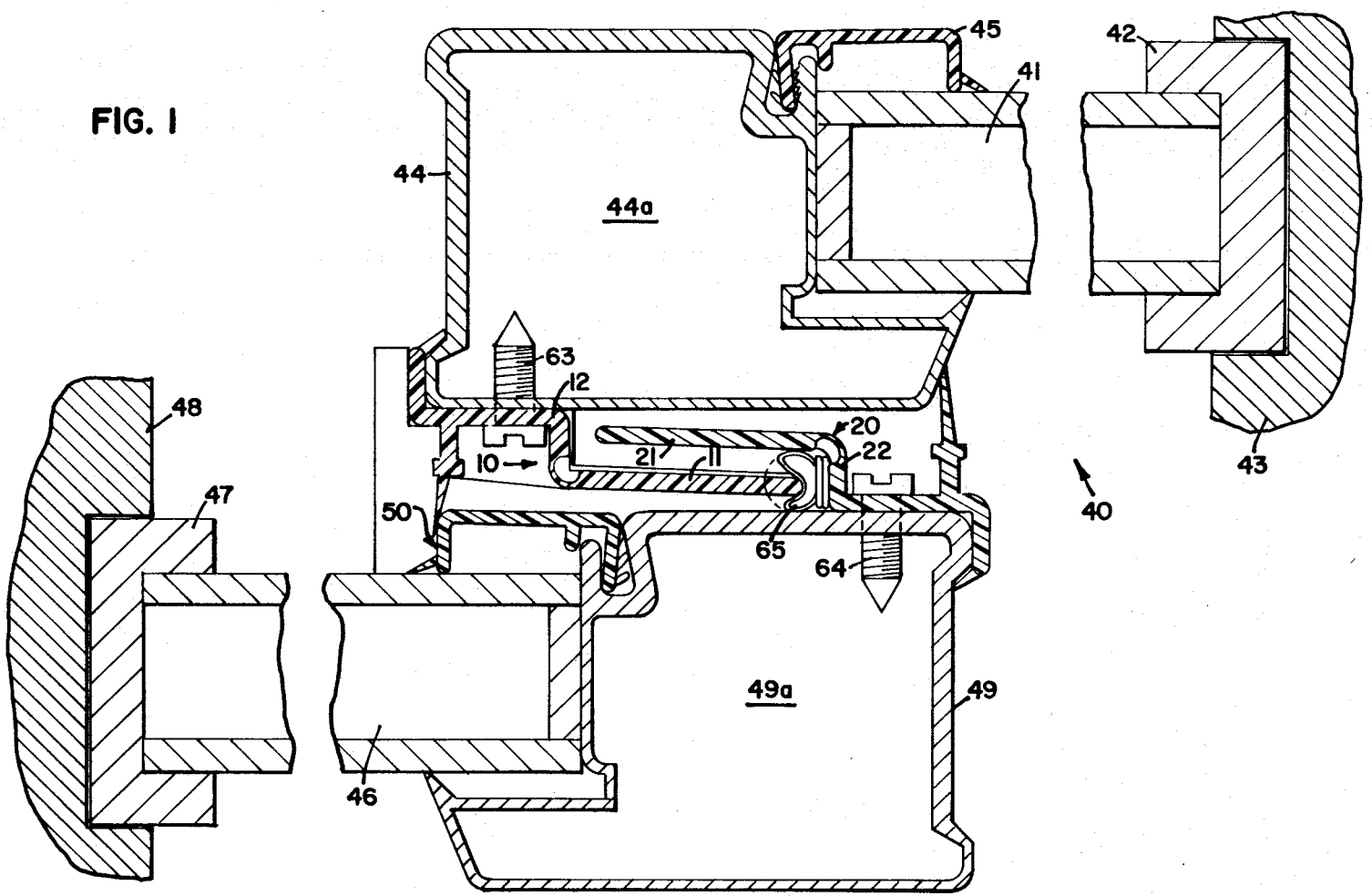
FIG. 1 is a horizontal cross-sectional view of a slideable panel unit incorporating the present invention.

While it is understood that the weatherstrip 20 may be utilized with any panel unit having a slideable panel, FIGS. 1 and 6 illustrate the present invention being utilized with a patio door unit having one operating panel and one stationary panel. A slideable panel unit is generally designated as 40 and is shown in FIGS. 1 and 6. The panel unit 40 includes a stationary panel 41 mounted in the stationary stile 42, stationary side jamb 43 and stationary meeting stile 44 having an inner wooden core 44*a*. A glazing bead 45 may also be cooperatively connected to the stationary meeting stile 44 by methods so known in the art. The operating panel 46 is cooperatively connected, by means of all known in the art, to the locking stile 47, operating side jamb 48 and operating meeting stile 49 having an inner wooden core 49*a*. A glazing bead 50 may also be incorporated, by methods well known in the art.

A vertical cross section of a typical patio door unit is shown in FIG. 6. This slideable panel unit 40 is mounted on the sub floor 51, the top of which is the finished floor 52 and optional threshold 53. The stationary panel 41 is cooperatively connected to the stationary panel bottom rail 54 and stationary bottom filler 54*a* at its lower end by methods well known in the art. Further, the top end of the stationary panel 41 is cooperatively connected to the stationary panel top rail 55 by means well known in the art. The operating panel 46 is mounted on the operating panel bottom rail 56 and operating bottom rail filler 56*a* at its lower end by methods well known in the art. The bottom rail 56 is cooperatively connected to rollers 57*a* having a groove. Sill 57 has an upwardly extending rib 56*b* which fits in the groove of 57*a* on which the operating panel 46 slides. A sill plug 58 is positioned between the two panels 41 and 46 and on top of the sill 59. The top end of the operating panel 46 is cooperatively connected to the operating panel top rail 60 by means well known in the art. Guide members 61 and 61*a* are cooperatively connected to the head jamb 62, also by methods well known in the art. A head plug 62*a* is positioned between the two panels 41 and 46 and on the bottom of the center guide member 61*a*.

The weatherstrip 10 is cooperatively connected to the stationary meeting stile 44 by a plurality of screws 63 which pass through the holes 14*a*. The weatherstrip 20 is cooperatively connected to the operating meeting stile 49 by a plurality of screws 64 which are positioned through the holes 24*a*. A silicone bulb weather seal 65 is cooperatively connected, by means well known in the art, to the weatherstrip 20 adjacent the offset member 22. The dotted line in FIG. 1 shows the bulb seal 65 when it is in an uncompressed state as will be more fully explained hereafter. The leading edge 16 of the weatherstrip 10 comes in contact with the bulb seal 65 and depresses it to the configuration shown in FIG. 1, thereby forming a seal.

In operation, the interlock formed by the two weatherstrips 10 and 20 operate much the same way a typical prior art interlock would operate when the panels 41 and 46 are straight. That is, when the operating panel 46 slides from an open position to a closed position, the engaging member 21 of the weatherstrip 20 passes between the engaging member 11 of the weatherstrip 10 and the stationary meeting stile 44 and stationary panel 41. When it reaches its closed position, as shown in FIG. 1, the leading edge of the engaging member 11 depresses the bulb seal 65 and forms a seal. Such is the operation of both the current invention and that of the prior art when the panels 41 and 46 are not bowed.

However, when either or both of the panels 41 and 46 are bowed, problems can result when the operating panel 46 is brought to a closed position. When the panels 41 and/or 46 are bowed, the engaging members 21 and 11 do not bypass, but instead clash. The notched effect of the leading edge of the engaging member 21 significantly reduces, and in most cases eliminates, clashing of the two weatherstrips on the panels 41 and 46. When the panels 41 and 46 are bowed, they typically are bowed only in their center region or if the bow extends throughout the height of the panels, they are bowed more significantly at the center region. Therefore, when prior art interlocks are closed, the clashing usually occurs at the center region of the weatherstrips. The clashing not only results in the panels not being fully closed, but also results in a loss of the weather seal formed with the bulb seal 65.

Figure 7:
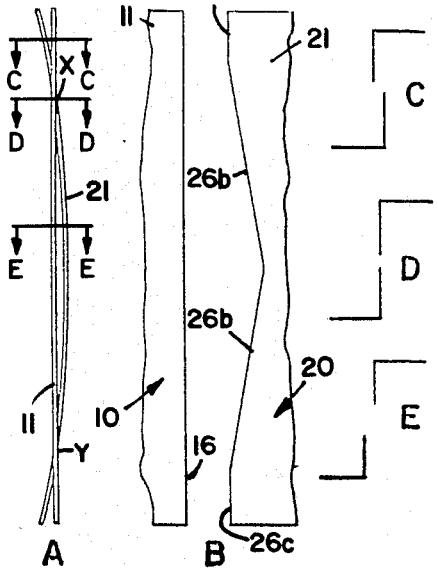
FIG. 7A is a schematic representation of a side view of the two portions of the interlock when the panels are in the position as shown in 7B.
FIGS. 7C, D and E are schematic cross-sections of FIG. 7A taken along lines C—C; D—D; and E—E respectively.

The present invention reduces and/or prevents such clashing and provides for a seal with the bulb seal 65 by allowing the panels to fully close. The manner in which clashing is presented can be seen in FIGS. 7A and B through 10A and B. For illustrative purposes only, only one of the panels is showed as being bowed. However, it is understood that both panels could be bowed. Further, the bow of the one panel is exaggerated for illustrative purposes.

Figure 8:
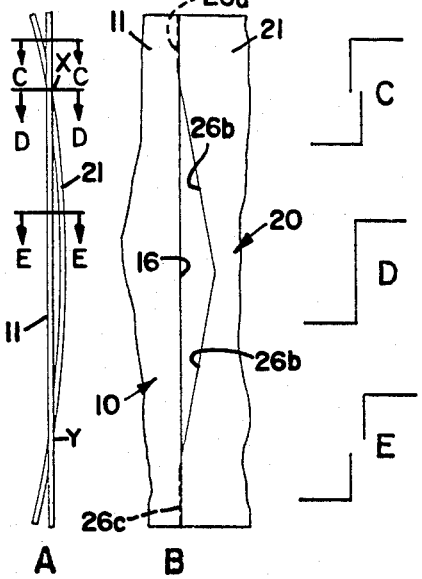
FIG. 8A is a schematic representation of a side view of the two portions of the interlock when the panels are in the position as shown in 8B.
FIGS. 8C, D and E are schematic cross-sections of FIG. 8A taken along lines C—C; D—D; and E—E respectively.

FIGS. 7A through 10A are schematic representations of the engaging members 11 and 21 of the weatherstrips 10 and 20 which are attached to the panels 41 and 46 respectively. However, for illustrative purposes, the panels have been removed and only the engaging members 11 and 21 are shown. FIGS. 7B through 10B are schematic views of the weatherstrips 10 and 20. FIGS. 7C through 10C; 7D through 10D and 7E through 10E are schematic cross-sections taken along the lines C—C; D—D and E—E respectively. Each FIG., 7 through 10, represents a schematic view of the weatherstrips 10 and 20 in a different position as the panels move from an open position to a closed position. It is shown that the weatherstrip 20 is cooperatively connected to a moving panel and the weatherstrip 10 is cooperatively connected to a stationary panel. FIGS. 7A through 7E show the invention when the weatherstrips and panels are in an open position. In FIG. 8, the moving panel has moved to a position wherein the leading edge 26*a* is just contacting the leading edge 16. FIGS. 9A through E show a view as the panel continues to close and FIGS. 10A through 10E show a representation as to when the panels are closed. The A figures are side views of the weatherstrips while the B figures are front plan view of the weatherstrips.

As shown in FIG. 7B, the panels would be in an open position and the weatherstrips 10 and 20 would not be in an overlying relationship. In FIG. 7A, the engaging member 21 is shown to have a bow and the engaging member 11 is shown to be straight. The engaging member and weatherstrip would take on the configuration of the panel to which it is secured. There is of course no clashing of the engaging members 11 and 21 at this point as they have not yet come into engagement with each other. As shown in FIG. 7C, the engaging members are in proper alignment where the bow of the weatherstrip 20 is not sufficient to cross the plane of the weatherstrip 10. However, when viewed farther down on the panels, as shown in FIG. 7D, the engaging members are in a position to clash when they are brought closer together. 7D is shown at the point x. Further down on the panel, as shown in FIG. 7E, the engaging members are out of alignment and would not interlock if closed.

FIG. 8 illustrates the engaging members when the leading edges 16 and 26*a–c* just begin to meet as the operating panel is being closed further. The weatherstrip 20 still has the same amount of bow in it as in FIG. 7. It can be seen that the bow of the weatherstrip 20 would cause clashing of the two engaging members of the weatherstrips if both were of conventional design, for the distance between points x and y. Points x and y represent the points where the bowed panel extends across the plane of the straight panel. However, the leading edge 26*b* of the weatherstrip 20 is notched out. Therefore, there is no leading edge on the weatherstrip 20 that would clash with the leading at 16 of weatherstrip 10. FIG. 8C, taken along lines C—C of FIG. 8, shows that the engaging members 11 and 21 are in proper alignment for forming an interlock. However, the panel is not yet closed sufficiently at this time so the leading edges 16 and 26 are just starting to pass one another. FIG. 8D shows that at point x, the leading edges would just begin to clash, if it were not for the notched out effect of the weatherstrip 20. Finally, FIG. 8E shows that the engaging members are out of alignment and would not interlock unless the bow of the panel is removed.

Figure 9:
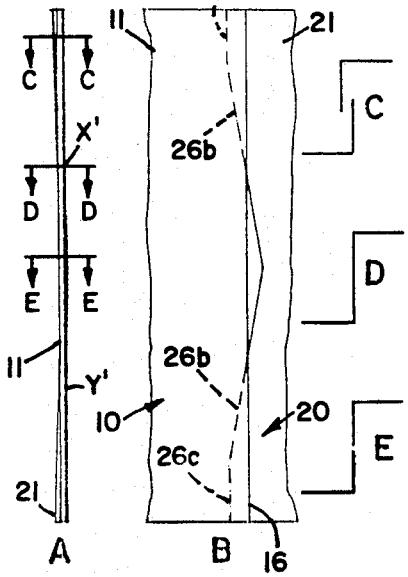
FIG. 9A is a schematic representation of a side view of the two portions of the interlock when the panels are in the position as shown in 9B.
FIGS. 9C, D and E are schematic cross-sections of FIG. 9A taken along lines C—C; D—D; and E—E respectively.

As the operating panel continues to close to the position shown in FIG. 9, a portion of the bow in weatherstrip 20 is beginning to be removed by the scissors action between the leading edge 16 and the leading edge 26*b*. This scissors action is accomplished by the fact that the leading edges 26*a* and 26*c* are in their proper overlying engagement with the leading edge 16, that is, the engaging member 21 is between the engaging member 11 and operating panel 41. However, where the panel is bowed, between points x′ and y′, the engaging member 21 is between the engaging member 11 and the stationary panel 46. This therefore means that there is at least one cross-over point where the engaging member 21 is in the same plane as the engaging member 11 and would clash. As the operating panel 46 is closed, the leading edges 26*b* create a scissors action with the leading edge 16 and forces the leading edge 16 back to a more straight position. The hinge action of the hinge areas 15 and 25 are also very instrumental in allowing for the scissors action to take place. Because of the hinge action, the first members 21 and 11 are able to be bent outward to further accommodate the scissors action between the leading edges 26*b* and 16. Further, as can be seen in FIG. 9A, the points where the bowed panels extend across the plane of the straight panel, x′ and y′, shown in FIG. 9B have moved closer to the center region and are the same height as the points of contact where the leading edges 26*b* contact the leading edge 16 as shown in FIG. 9A. FIG. 9C again shows the engaging members 11 and 21 in the proper interlocking alignment. FIG. 9D shows that the leading edges 16 and 26 would be clashing at the point x′ if it were not for the notched out effect of the weatherstrip 20. Again in FIG. 9E, the misalignment of the engaging members 11 and 21 is shown.

Figure 10:
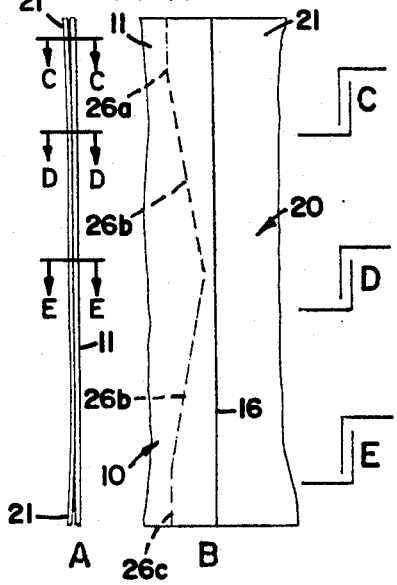
FIG. 10A is a schematic representation of a side view of the two portions of the interlock when the panels are in the positions as shown in 10B.
FIGS. 10C, D and E are schematic cross-sections of FIG. 10A taken along lines C—C; D—D; and E—E respectively.

Finally, as shown in FIG. 10, the operating panel 46 is in the completely closed position and the bowed panel has now been straightened to allow the panels to be completely closed without clashing. The proper overlying relationship of the engaging members 11 and 21 is now shown in FIGS. 10C, 10D and 10E, the leading edge 16 having removed the bow of the weatherstrip 20 by the previously described scissors action.

It is understood that the weatherstrip 10 may also incorporate the notched effect of weatherstrip 20. However, it may be more difficult to effect a seal with the bulb seal 65 if both weatherstrips have a notched area.

It is understood that the present invention may also be incorporated multiple panel units having one, two, three or more moving panels.

The rounded edges of the leading edges 16 and 26 further assist in reducing clashing and also allowing for a better scissors action between leading edge 16 and leading edge 26*b*.

Other modifications of the invention will be apparent to those skills in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follows in the spirit and broad scope of the appended claims are included.

We claim:

1. A weatherstrip for use with a slideable panel unit having a first panel and a second panel, one of the panels being a slideable panel, comprising:

(a) an engaging member having a leading edge and having a first end, center region and a second end;

(b) an offset member cooperatively connected to said engaging member, herein when said offset member is connected to one of the panels, said engaging member is in a generally parallel spaced relationship to said one of the panels; and (c) said leading edge of said engaging member is inwardly displaced at said center region with respect to said leading edge at said end regions, whereby said inwardly displaced center region reduces clashing between the panels when one of the panels is bowed.

2. The weatherstrip of claim 1, wherein said leading edge is rounded.

3. The weatherstrip of claim 1, further comprising means for providing a hinge action between said engaging member and said offset member.

4. The weatherstrip of claim 3, wherein said hinge means comprises said engaging member and offset members of a rigid material connected in adjoining relationship by a hinge section, said hinge section having a first ply of lesser thickness than said engaging and offset members but having the same hardness and a second ply underlying and integrally formed with said first ply, but having a hardness less than said first ply.

5. A slideable panel unit interlock, the unit having a first panel and a second panel, one of the panels being a slideable panel, comprising:

(a) a first weatherstrip cooperatively connected to the first panel and extending substantially the length of the first panel, said first weatherstrip having a first member cooperatively connected to a second member, said second member extending away from the first panel, whereby said first member is in a spaced relationship to the first panel;

(b) a second weatherstrip cooperatively connected to the second panel and extending substantially the length of the second panel, said second weatherstrip having a first member cooperatively connected to a second member, said second member extending away from the second panel, whereby said first member is in a spaced relationship to the second panel and when the panels are in a closed position said first member of said first weatherstrip is between said first member of said second weatherstrip and the second panel; and (c) one of said weatherstrips having its first member having a width at its center region smaller than its width at at least one of its ends, whereby when the panels move from an open position to a closed position, said smaller center width preventing clashing when one of the panels is bowed.

6. The interlock of claim 5, further comprising one of said weatherstrips having means for providing a hinge action between its first and second members.

7. The interlock of claim 5, wherein both of said weatherstrips have a means for providing a hinge action between there respective first and second members.

8. The interlock of claim 5, wherein said hinge means comprises said first and second members of a rigid material connected in adjoining relationship by a hinge section, said hinge section having a first ply of lesser thickness than said first and second members but having the same hardness and a second ply underlying and integrally formed with said first ply of said hinge section, but having a hardness substantially less than said first ply.

9. The interlock of claim 5, wherein said one of said weatherstrips smaller center width forms a generally V-shaped notch.

10. The interlock of claim 5, wherein said leading said one of said weatherstrips first member has a rounded leading edge.

11. A slideable panel unit comprising:

(a) a first panel;

(b) a second panel, said second panel slideable with respect to said first panel between an open position and a closed position;

(c) a first weatherstrip cooperatively connected to the first panel and extending substantially the length of the first panel, said first weatherstrip having a first member cooperatively connected to a second member, said second member extending away from the first panel, whereby said first member is in a spaced relationship to the first panel;

(d) a second weatherstrip cooperatively connected to the second panel and extending substantially the length of the second panel, said second weatherstrip having a first member cooperatively connected to a second member, said second member extending away from the second panel, whereby said first member is in a spaced relationship to the second panel and when the panels are in a closed position said first member of said first weatherstrip is between said first member of said second weatherstrip and the second panel; and (e) one of said weatherstrips having its first member having a width at its center region smaller than its width at at least one of its ends, whereby when the panels move from an open position to a closed position, said smaller center width preventing clashing when one of the panels is bowed.

12. The slideable panel unit of claim 11, further comprising one of said weatherstrips having means for providing a hinge action between its first and second members.

13. The slideable panel unit of claim 11, wherein both of said weatherstrips have a means for providing a hinge action between their respective first and second members.

14. The slideable panel unit of claim 11, wherein said hinge means comprises said first and second members of a rigid material connected in adjoining relationship by a hinge section, said hinge section having a first ply of lesser thickness than said first and second members but having the same hardness and a second ply underlying and integrally formed with said first ply of said hinge section, but having a hardness substantially less than said first ply.

15. The slideable panel unit of claim 11, wherein said one of said weatherstrips smaller center width forms a generally V-shaped notch.

16. The slideable panel unit of claim 11, wherein said leading said one of said weatherstrips first member has a rounded leading edge.

* * * * *